US008075223B2

(12) United States Patent
Ansay et al.

(10) Patent No.: US 8,075,223 B2
(45) Date of Patent: Dec. 13, 2011

(54) DEPLOYMENT SYSTEM FOR FIBER-OPTIC LINE SENSORS

(75) Inventors: Michael T. Ansay, Johnston, RI (US); Angelo Di Biasio, Narragansett, RI (US); Mariela I. Santiago, Portsmouth, RI (US); Robert W. Goldman, Portmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 44 days.

(21) Appl. No.: 12/386,185

(22) Filed: Mar. 27, 2009

(65) Prior Publication Data

US 2010/0247244 A1 Sep. 30, 2010

(51) Int. Cl.
*F16L 1/12* (2006.01)
*H02G 1/10* (2006.01)

(52) U.S. Cl. ..... 405/158; 405/171

(58) Field of Classification Search ..... 405/154.1, 405/158, 166, 169, 171; 367/131, 132, 133, 367/134

See application file for complete search history.

(56) References Cited

U.S. PATENT DOCUMENTS

| | | | | |
|---|---|---|---|---|
| 5,398,636 | A * | 3/1995 | Hillenbrand | 114/312 |
| 5,747,754 | A * | 5/1998 | Svenning et al. | 367/165 |
| 6,390,012 | B1 * | 5/2002 | Watt et al. | 114/322 |
| 6,474,254 | B1 * | 11/2002 | Ambs et al. | 405/167 |
| 6,681,711 | B2 * | 1/2004 | King | 405/158 |
| 6,691,636 | B2 * | 2/2004 | King | 405/158 |
| 7,194,975 | B2 * | 3/2007 | Potter et al. | 114/312 |
| 7,210,556 | B2 * | 5/2007 | Bath et al | 367/133 |
| 7,324,406 | B2 * | 1/2008 | Berg | 367/141 |
| 7,632,043 | B2 * | 12/2009 | Thompson et al. | 405/190 |
| 7,675,821 | B2 * | 3/2010 | Berg et al. | 367/15 |
| 2007/0123122 | A1 * | 5/2007 | Puzella et al. | 441/11 |

* cited by examiner

*Primary Examiner* — Frederick L Lagman
(74) *Attorney, Agent, or Firm* — James M. Kasischke; Michael P. Stanley; Jean-Paul A. Nasser

(57) ABSTRACT

A system for deploying a fiber optic line sensor is provided that includes a launch vehicle to which three sections are attached. The first section is a buoy antenna section. The second section is an electronics canister section having control electronics. These sections are releasably attached to the launch vehicle. The electronics canister section is in contact with the antenna section and secured to the antenna section by a spring band. A communications cable is attached between the antenna and the control electronics. The third section is a spool section containing a spool of a fiber optic line sensor. This third section is attached to the launch vehicle by a rigid mount and is in contact with the electronics canister section. The fiber optic line sensor extends from the spool section into the electronics canister section to the control electronics.

17 Claims, 14 Drawing Sheets

DEPLOYMENT SYSTEM FOR FIBER-OPTIC LINE SENSORS

STATEMENT OF GOVERNMENT INTEREST

The invention described herein may be manufactured and used by or for the Government of the United States of America for Governmental purposes without the payment of any royalties thereon or therefor.

CROSS REFERENCE TO OTHER RELATED APPLICATION

None.

BACKGROUND OF INVENTION

1) Field of the Invention

The present invention is directed to underwater fiber optic sensors and in particular to deployment systems for the fiber optic sensors.

2) Description of Prior Art

Fiber optics and fiber optic sensors can be used as an alternative or replacement for traditional sensors to measure rotation, acceleration, electric and magnetic field measurement, temperature, pressure, acoustics, vibration, linear and angular position, strain, humidity and viscosity among other measurements. Fiber optic sensors are lightweight, small, passive, low powered, resistant to electromagnetic interference, high sensitivity, wide bandwidth and environmentally rugged. These sensors can be used in harsh environments including underwater environments such as the ocean floor. This compatibility of optical sensors within a harsh marine environment creates opportunities to use fiber optic sensors for tactical or reconnaissance applications.

For example, a long fiber optic sensor deployed along the ocean floor for several miles can be used to monitor submarine traffic covertly leaving an enemy port. Any submarine that passes over the fiber optic sensor is detected. This presence is communicated through an antenna section to distant command groups. However, a need still exists for a deployment system that can reliably deploy the fiber optic sensor.

SUMMARY OF THE INVENTION

A system and method in accordance with exemplary embodiments of the present invention are directed to underwater deployment systems for fiber optic line sensors.

The deployment system of the present invention positions fiber optic line sensors within littoral environments. Once positioned, the line sensors remain in their deployed positions for extended periods of time.

The deployment system includes a buoyant antenna section in communication with a control electronics section. The antenna of the antenna section is used to transmit signals from the fiber optic line sensors.

In one embodiment, the deployment system works in combination with a large Unmanned Underwater Vehicle (UUV) to deliver the fiber optic sensor to the desired location. Once the UUV is positioned in the desired location, the UUV signals a linear actuator to trigger two quick release devices. The first quick release device is on the antenna section and the second quick release device is on the electronic canister section. The electronic canister section includes control electronics and a power supply for the fiber optic line sensor.

Using the first and second quick release devices, both sections would then separate from the large UUV. As the two sections combined are negatively buoyant, these sections fall away from the large UUV. After the two sections have fallen a safe distance from the UUV (which is equal to the length of a retractable lanyard disposed between the two sections and the UUV); a spring band disposed between the two sections is released. Releasing the spring band allows the buoyant antenna section to separate from the electronics canister. The electronics canister continues falling toward the seafloor and the antenna section rises to the surface.

The electronics canister eventually comes to rest on the seafloor. The fiber optic line sensor remains disposed between the electronics canister that is now resting on the seafloor and the UUV. The UUV moves away from the electronics canister in accordance with a pre-determined pattern to deploy the fiber optic line sensor along that pattern.

Once deployed, the system remains in a standby position. When a submarine passes over the sensor, a pressure signal is detected by the deployed fiber optic line sensor. The pressure signal is processed by the electronics in the electronics canister. The resulting information is relayed to a central location via the buoyant antenna section.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Figure 1:
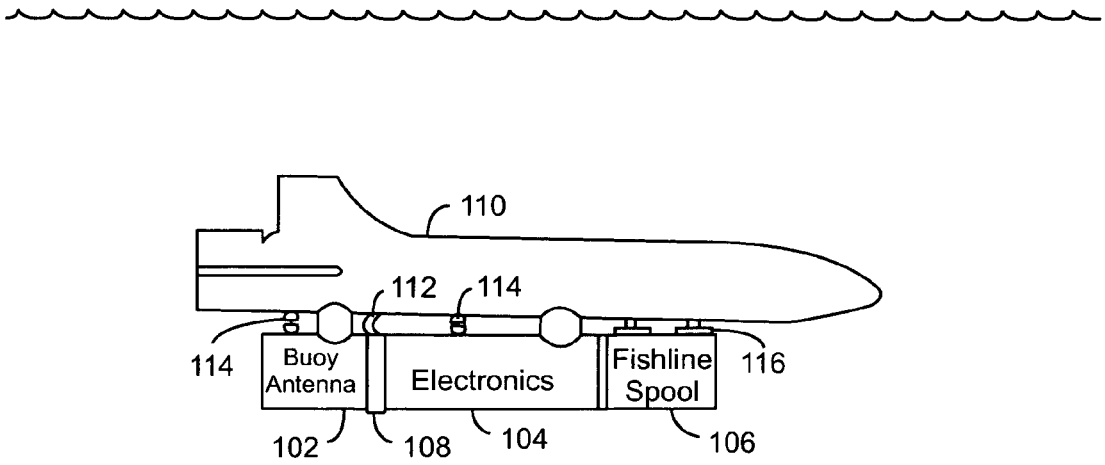
FIG. 1 is side view of an embodiment of a deployment system in accordance with the present invention in which the view includes an unmanned undersea vehicle.
Figure 2:
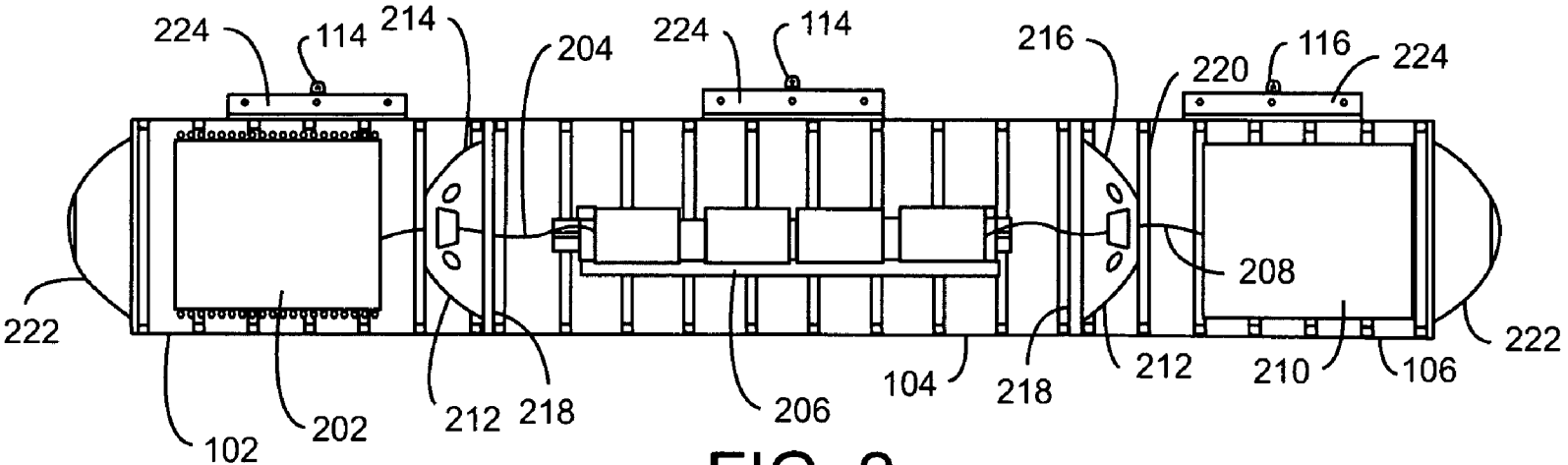
FIG. 2 is a cross-section view of the three sections of the deployment system.
Figure 3:
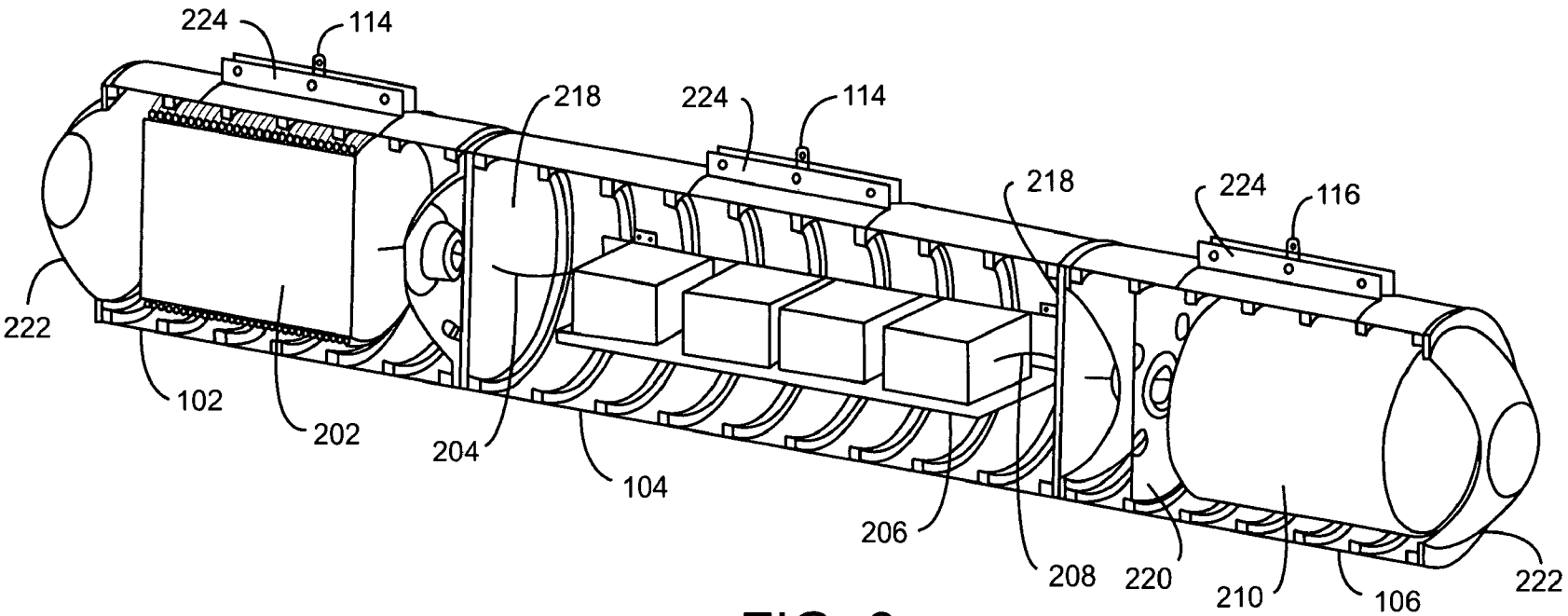
FIG. 3 is a perspective cross-section view of the three sections of the deployment system.

Referring initially to FIGS. 1-3, an exemplary embodiment of a deployment system for a fiber optic line sensor arranged for use with a UUV is illustrated. The deployment system includes three sections, a buoy antenna section 102, an electronics canister section 104 and a "fishline" spool section 106. The antenna section 102 contains an antenna 202 that is used to transmit detection signals to a monitoring station, for example, a localized Navy command group. The antenna section 102 is positively buoyant such that the antenna section will float to the surface of a body of water.

In one embodiment, the antenna section 102 is generally cylindrical and one end of the antenna section is in contact with the electronics canister section 104. The antenna section 102 in combination with the electronics canister section 104 is negatively buoyant because the electronics canister section is more negatively buoyant than the antenna section is positively buoyant.

During transport and at initial deployment, the antenna section 102 is securely attached to the electronics canister section 104. Preferably, a breakaway interface is provided between the antenna section 102 and the electronics canister section 104. In one embodiment, the breakaway interface is a circumferential spring band 108 that surrounds the interface joint between the cylindrical antenna section 102 and the cylindrical electronics canister section 104. The spring band 108 secures the two sections together until triggered to spring open.

In one embodiment, the spring band 108 is triggered to spring open when the two connected sections drop a safe distance-away from a launch vehicle 110. In another embodiment, the launch vehicle 110 can be considered part of the deployment system.

In one embodiment, the deployment system includes a triggering mechanism 112 to trigger the spring band 108. The triggering mechanism 112 can be a retractable lanyard or other suitable rigging that is secured between the launch vehicle 110 and the spring band 108. The triggering mechanism 112 has a length sufficient to allow the antenna section 102 and the electronics canister section 104 to travel a safe distance from the launch vehicle 110 before the antenna section is separated from the electronics canister section.

Once the spring band 108 has been released by the triggering mechanism 112, the buoyant antenna section 102 is free to ascend to the surface of the ocean while the electronics canister section 104 descends to the ocean floor. As the buoyant antenna section 102 ascends away from the electronics canister section 104, a sufficient length of communications cable 204 or buoyant antenna cable is paid out between the two sections. The communication cable 204 is fixedly secured to both sections and is in communication with both the antenna 202 in the antenna section 102 and the control electronics 206 within the electronics canister section 104. The antenna section 102 remains connected to the electronics canister section 104 through the communications cable 204. Therefore, the communication cable 204 also serves as an anchor line for the antenna section 102. The communication cable 204 has a sufficient length to reach the surface of the ocean when the electronics canister section 104 is on the ocean floor and a sufficient strength to hold the buoyant antenna section 102 in place against the force of wind, waves and ocean currents.

The electronics canister section 104 contains the control electronics 206 required to power and to operate the fiber optic line sensor 208 and to detect approaching vessels. These control electronics include, but are not limited to, power supplies such as batteries, electronics, communication interfaces, memory devices, light sources and central processing units. The electronics canister section 104, once deployed, also functions as an anchor for the buoyant antenna section 102 and the fiber optic line sensor 208. In one embodiment, the electronics canister section 104 is cylindrical. Initially, one end of the electronics canister section 104 is in contact with an end of the antenna section 102 and is secured to the antenna section by the breakaway mechanism 108.

The electronics canister section 104 is initially connected to the antenna section 102. However, once the launch vehicle 110 releases the two sections, the sections will separate after achieving a safe distance from the large UV. In one embodiment, separation is achieved by a combination of a mechanical spring band as the breakaway mechanism 108 and a retractable lanyard 112. The electronics canister section 104 continues a descent until striking the ocean floor. As the electronics canister section 104 falls, the section draws the fiber optic line sensor 208 from a spool 210 located within the spool section 106.

The electronics canister section 104 also includes two protective covers 212 located at either end of the electronics canister section. These protective covers include a first protective cover 214 between the electronics canister section 104 and the antenna section 102 and a second protective cover 216 between the electronics canister section 104 and the spool section 106. The protective covers are visible on the outside and define the rounded shape of the two ends of the electronics canister section 104.

Figure 4:
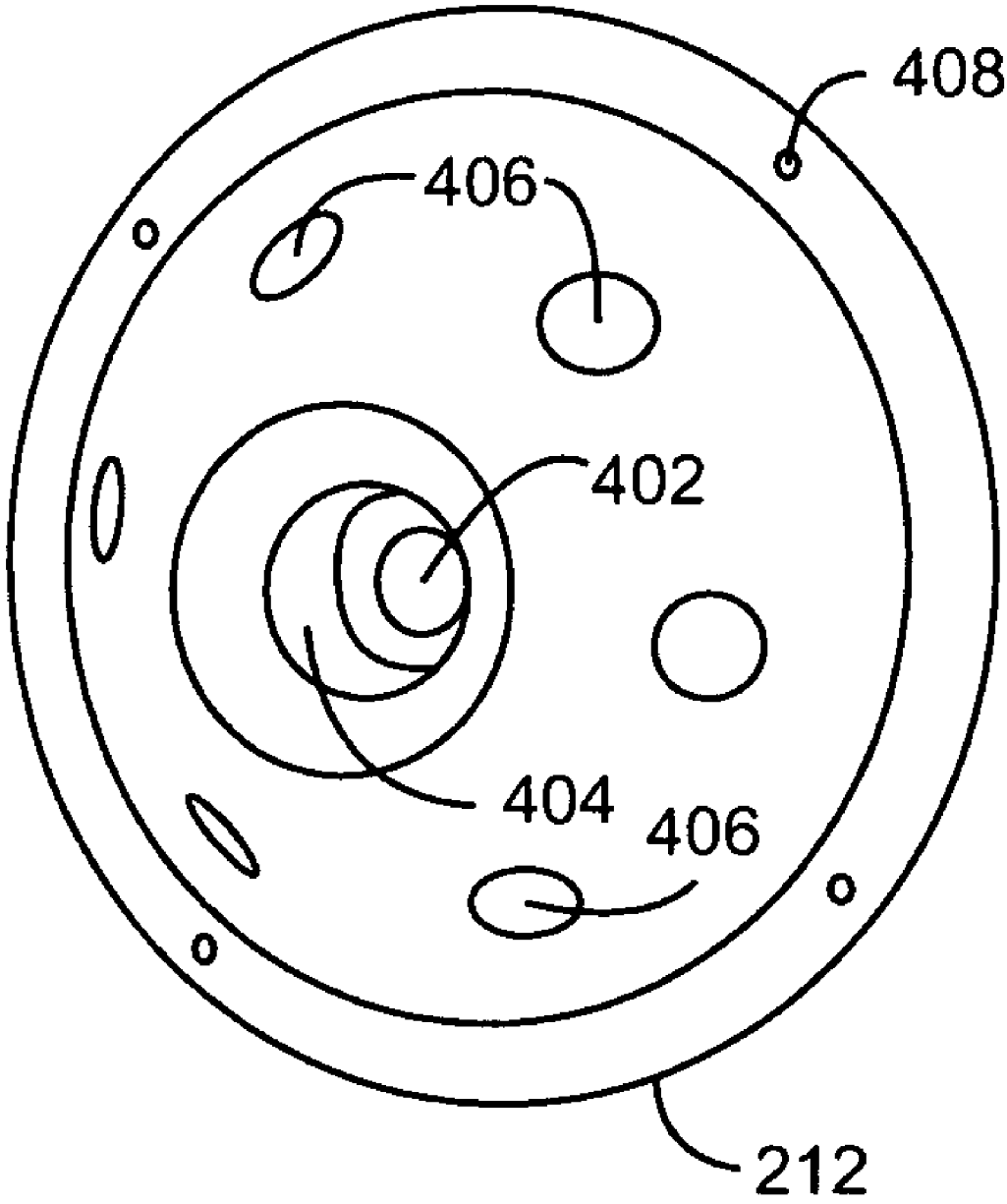
FIG. 4 is a front perspective view of an embodiment of a protective cover for use in the deployment system.

Referring now to FIG. 4, each protective cover 212 is convex. The protective covers 212 are arranged to protect the delicate control electronics 206 contained inside the electronics canister section 104 as well as the fiber optic line sensor 208 and the buoyant antenna cable 204. The protective covers 212 are constructed from a thin material (e.g. metal or plastic) which absorbs the shock of impact. The protective covers 212 can dent or deform without damaging any other components of the deployment system. The protective covers 212 are also generally circular to accommodate the cylindrical sections and include a central hole or aperture 402 to accommodate either the communications cable 204 or the fiber optic line sensor 208—depending on the end of the electronics canister section 104 to which the cover is attached. A well 404 is disposed around the central hole 402 to prevent damage to the communications cable 204 or the fiber optic line sensor 208 when the electronics canister section 104 contacts the seafloor.

The wells 404 prevent the connectors from being bent if the canister section 104 lands on an end. The wells 404 also protect the fiber optic line sensor 208 and the cable 204 from being pinched or kinked. Each protective cover 212 includes a plurality of openings, apertures or holes 406 to allow water to flow freely through the protective cover. Attachment to the electronics canister section 104 can be provided by fasteners passed through a plurality of apertures or holes 408 in the protective cover 212.

Returning to FIG. 2 and FIG. 3, both ends of the electronics canister section 104 include an end plate 218 disposed between the ends of the electronics canister section and the protective covers. The end plates 218 provide the watertight seal for the electronics canister section 104. The antenna cable 204 and the fiber optic line sensor 208 pass through the end plates 218 while maintaining the watertight seal.

Figure 5:
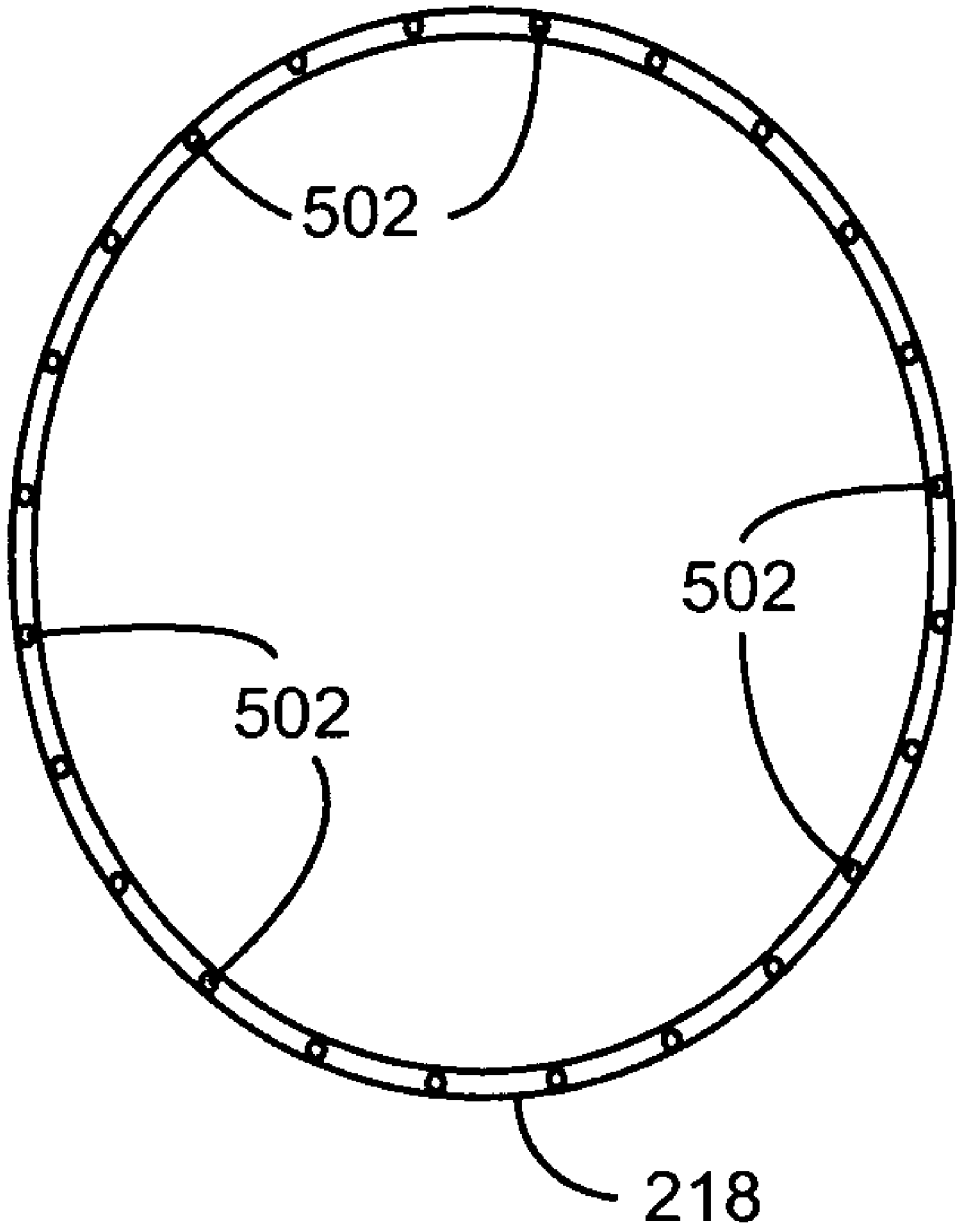
FIG. 5 is a front perspective view of an embodiment of an end plate for use in the deployment system.

Referring now to FIG. 5, an embodiment of the end plate 218 is illustrated. The end plate 218 is arranged as a circular flange to accommodate the cylindrical sections and includes a plurality of fastener apertures or holes 502 to attach to the end plate 218 of the electronics canister section 104.

The spool section 106 can contain up to several miles of the fiber optic line sensor 208, which is, precision wound around a spool 210. The fiber optic line sensor 208 is loosely wound to minimize the tensile load during deployment. In one embodiment, the spool section 106 is cylindrical.

The spool section 106 is free-flooded, so that seawater is allowed to flow freely in and out. One end of the spool section 106 is in contact with the electronics canister section 104 and includes an internal plate 220 disposed between the electronics canister section 104 and the spool 210.

Figure 6:
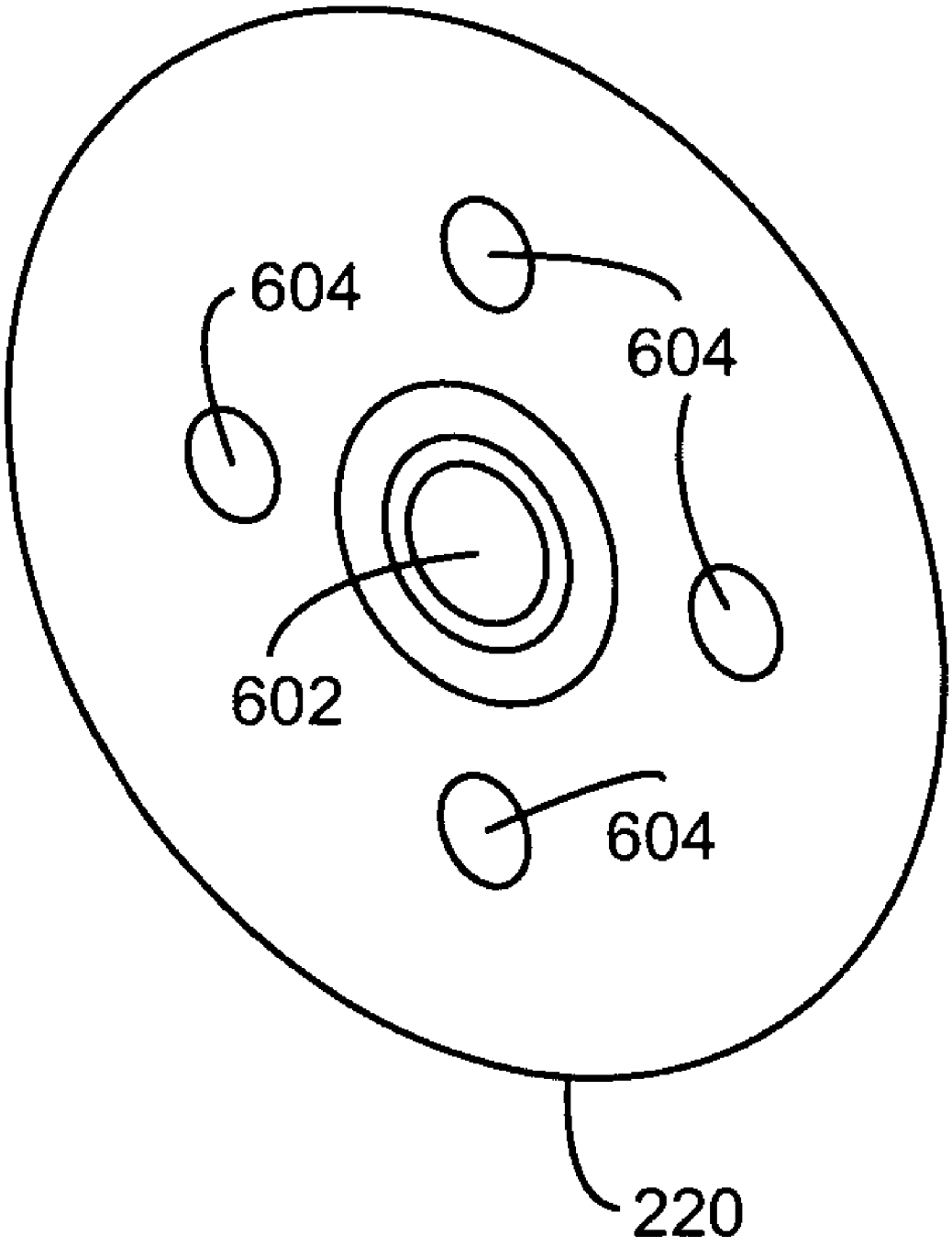
FIG. 6 is a front perspective view of an embodiment of an internal plate for use in the deployment system.

As illustrated in FIG. 6, the internal plate 220 includes a plurality of flow ports or apertures 604 to allow seawater to flow freely into the spool section 106. In one embodiment, the internal plate 220 is circular and includes a central aperture 602 to allow passage of the fiber optic line sensor 208.

Figure 7:
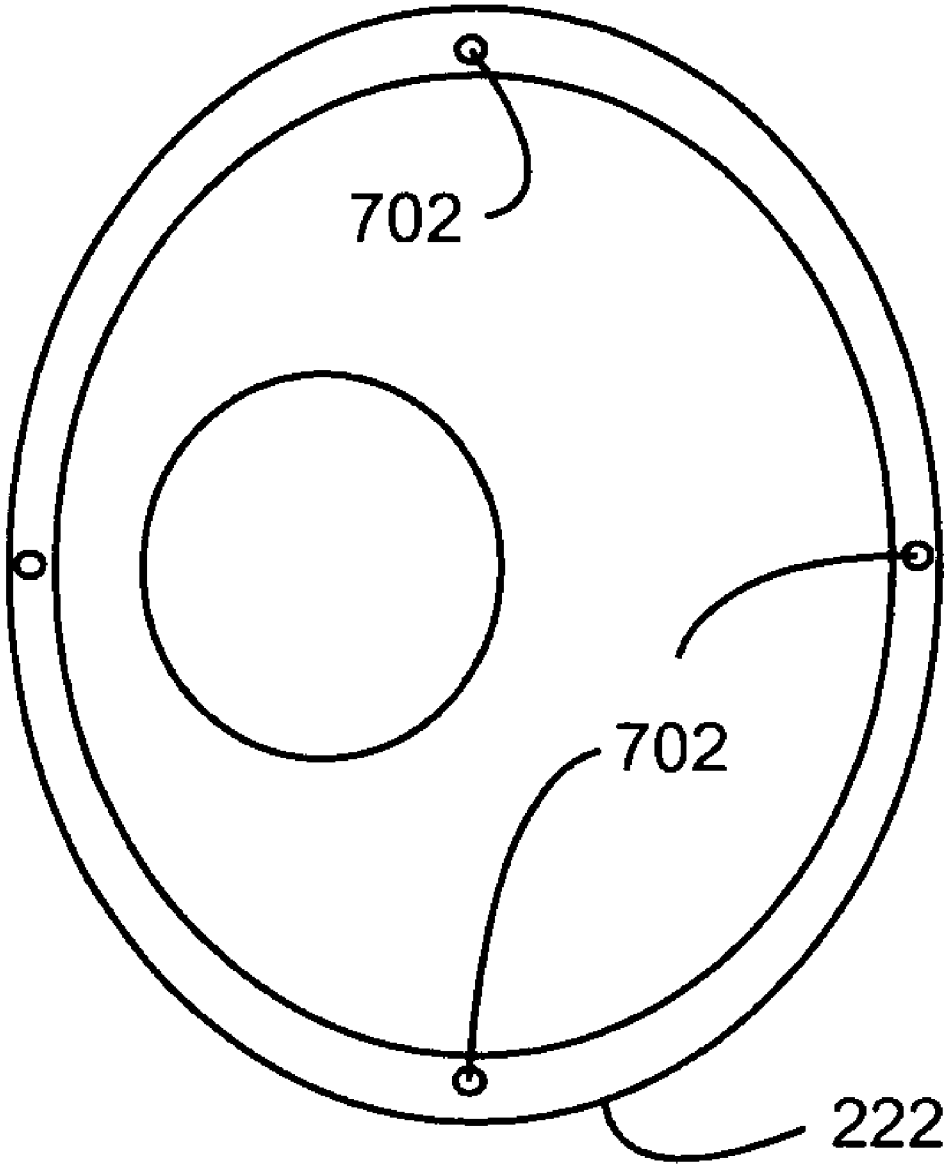
FIG. 7 is a front perspective view of an embodiment of an end cover for use in the deployment system.

The other end of the spool section 106 opposite the end in contact with the electronics canister section 104 includes an end cover 222. Another end cover 222 is attached to the antenna section 102 on an end opposite the end attached to the electronics canister section 104. As illustrated in FIG. 7, each end plate 222 is arranged as a convex cap on one end of the deployment system and includes a plurality of flange apertures 702 to be used in connecting the end cap to the appropriate sections.

In one embodiment, the fiber optic line sensor 208 may be wound with a weak binder to prevent the fiber optic line sensor from unraveling. Alternatively, the fiber optic line sensor 208 is freely wound. In another embodiment, the fiber optic line sensor 208 is pre-twisted or precision wound to ensure that the fiber optic line sensor pays out straight without tangles and loops along a length once the fiber optic line sensor is deployed on the seafloor.

In one embodiment, a winding drum is contained inside the spool section 106 to assist with and to contain the loose winding of the fiber optics when a binder is not used. In this situation, finger strips (not shown) are placed inside the winding drum to separate layers or rows of the concentrically coiled line sensor. As the fiber optic line sensor 208 deploys, the fiber optic line sensor pays out from the concentrically-coiled winding drum while moving back and forth similar to the operation of a fishing reel.

Figure 8:
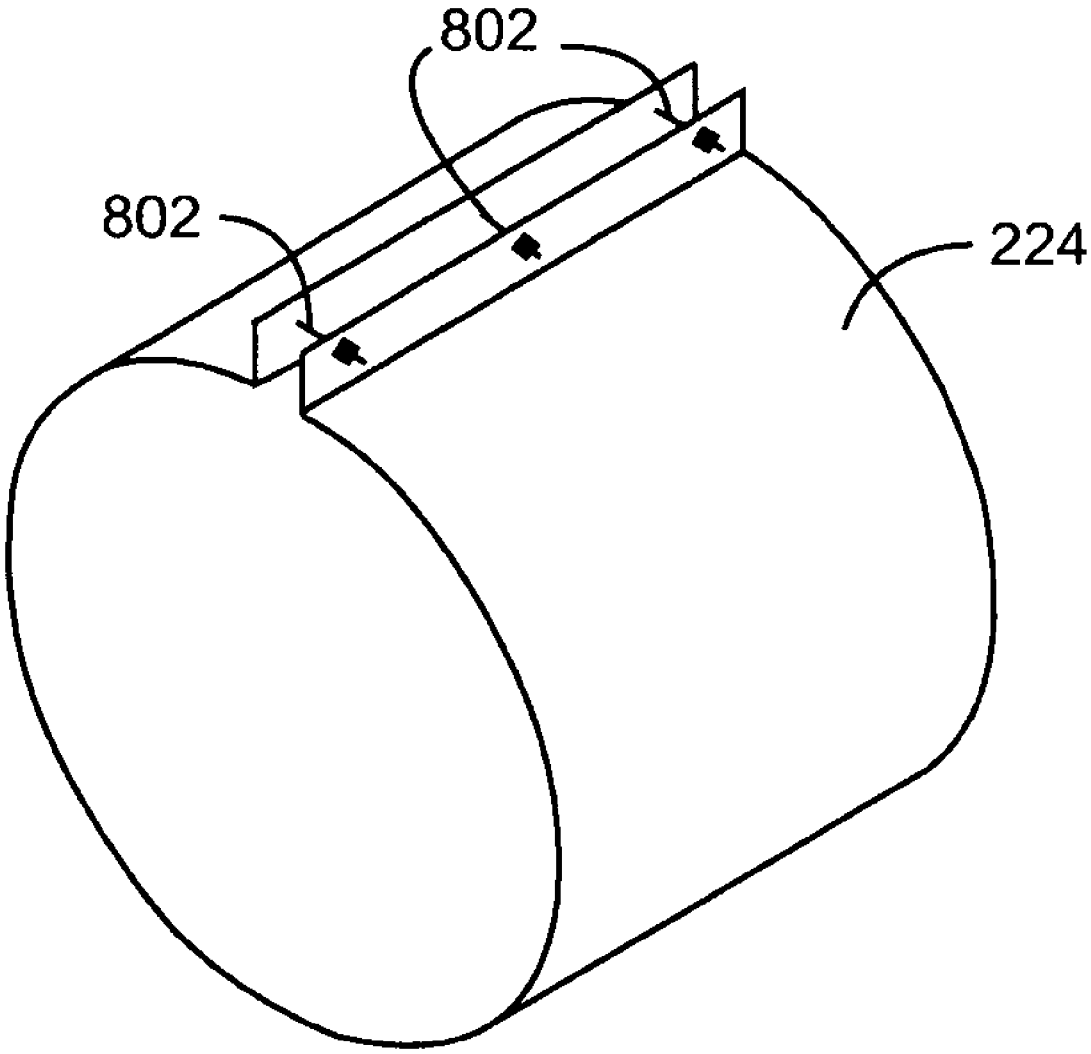
FIG. 8 is a top perspective view of an embodiment of a section support band for use in the deployment system.

The electronics canister section 104, the antenna section 102 and the spool section 106 are suspended beneath launch vehicles using at least one section support band 224 attached to each section. As illustrated in FIG. 8, each section support band 224 is arranged as a cylindrical sleeve that encircles a section of the deployment system and includes a plurality of fasteners 802 (for example, a plurality of nut and bolt fasteners) to constrict the band around the section and secure the section support band 224. Supports run from the section support bands 224 to the launch vehicle 110. These supports include quick release shackles 114 running between the launch vehicle 110 and the antenna section 102 and the electronics canister section 104 and one rigid mount 116 running between the launch vehicle and the spool section 106.

Figure 9:
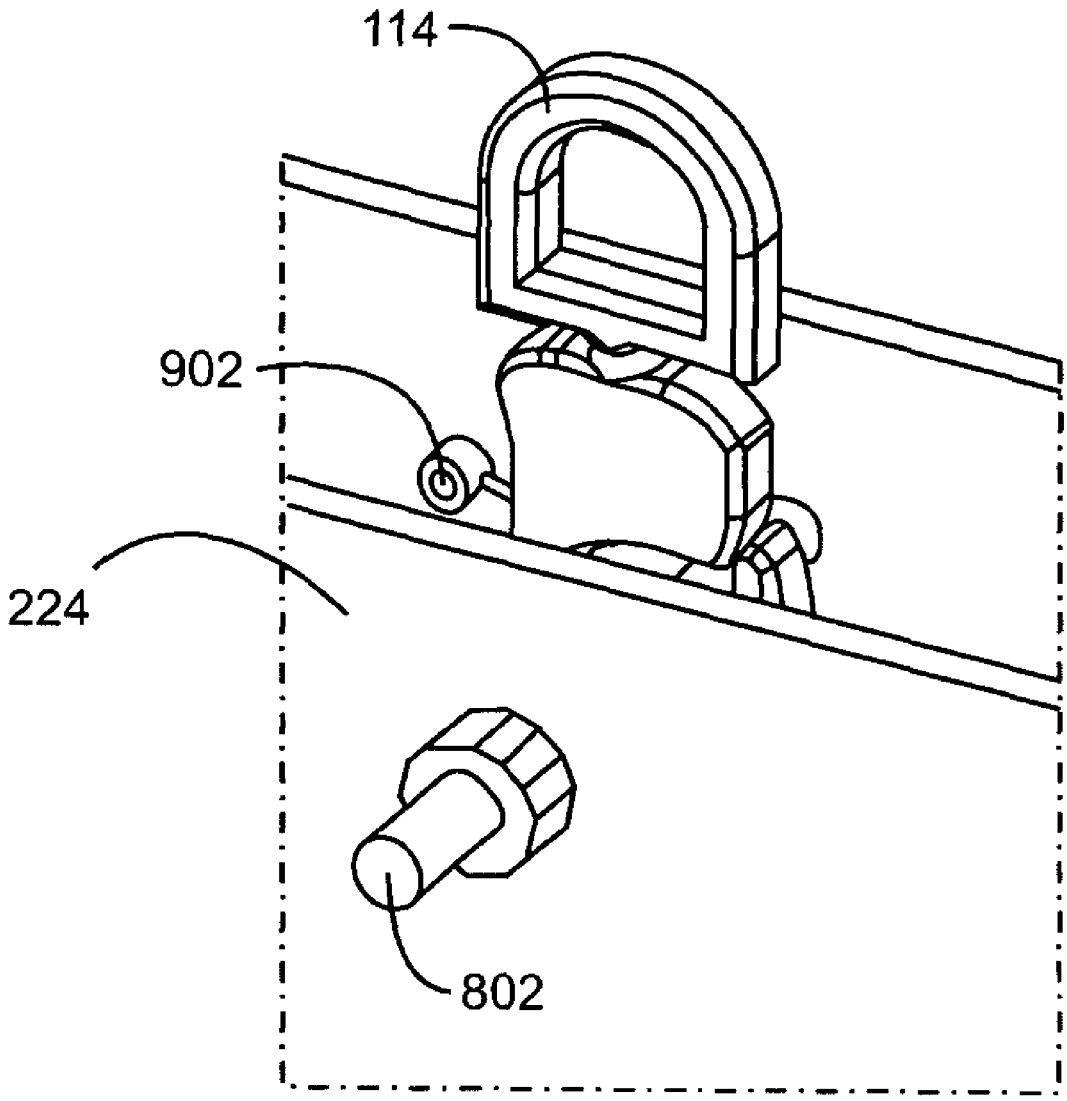
FIG. 9 is a perspective view of an embodiment of a quick release shackle attached to the section support band.
Figure 10:
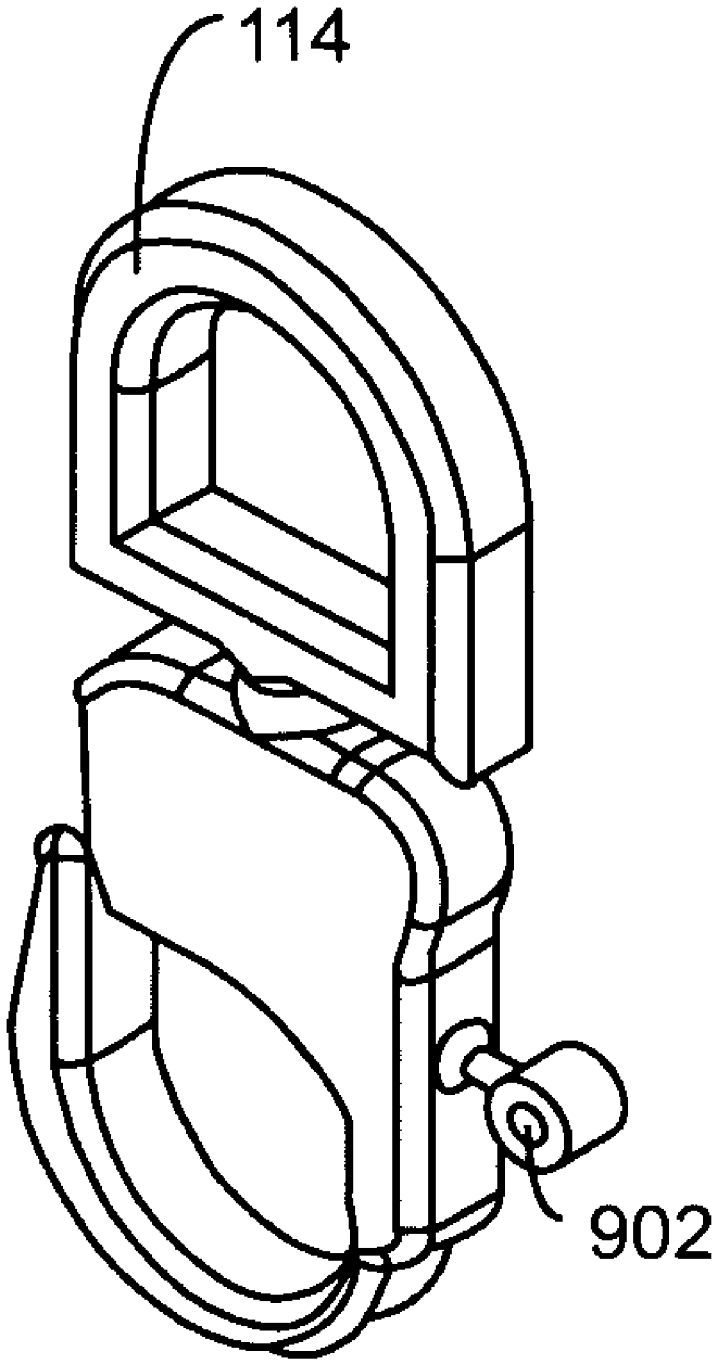
FIG. 10 is a perspective view of an embodiment of a quick release shackle.
Figure 11:
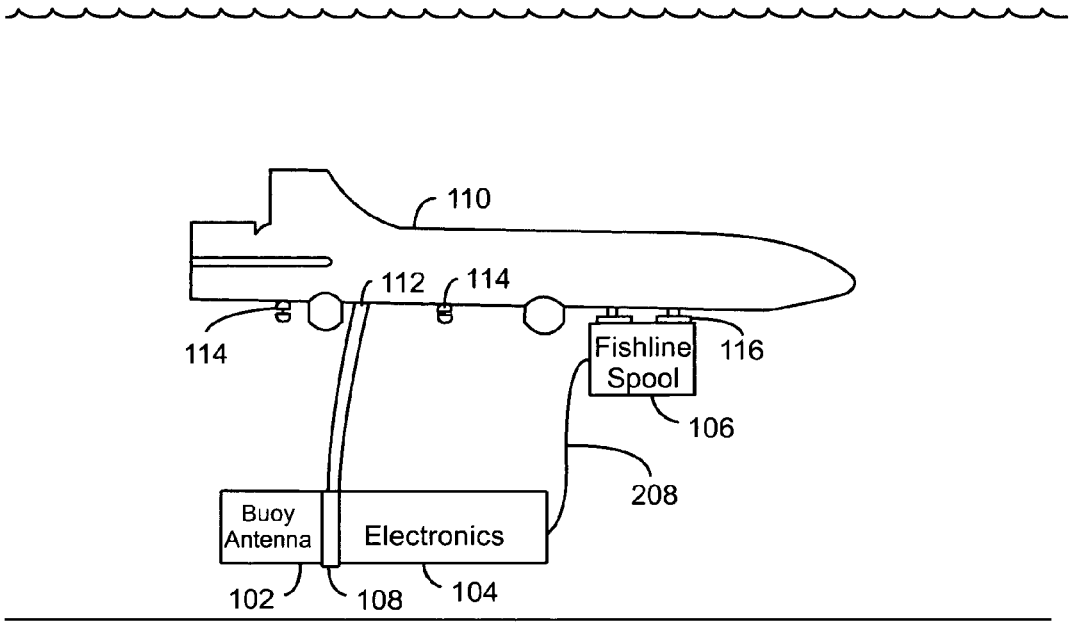
FIG. 11 is a side view illustrating the release of the buoy antenna section and electronics canister section from the launch vehicle.

Referring now to FIGS. 9 and 10, the two mechanical quick release shackles 114 are used to support the weight of the electronics canister section 104 and the antenna section 102 underneath the launch vehicle 110. In one embodiment, each quick release shackle 114 is attached to one of the bolt fasteners 802. Once the launch vehicle 110 reaches a designated location, a linear actuator attached to the launch vehicle pulls a cord that is attached to a release mechanism 902 on each one of the quick release shackles 114. This pulling causes the two quick release shackles 114 to open. The quick release shackles 114 are activated at the same time, such that the assembly is simultaneously released at both points and falls away from the launch vehicle 110 in a generally straight and level fashion.

The rigid mount 116 is disposed between the spool section 106 and the launch vehicle 110—for example, attaching to one of the bolt fasteners 802. The rigid mount 116 does not release the spool section 106 from the launch vehicle 110 when the quick release shackles 114 release the electronics canister section 104 and the antenna section 102. As the launch vehicle 110 moves away from the electronics canister section 104 that has been released from the launch vehicle and is resting on the ocean bottom, the spool section 106 moves along with the launch vehicle. This relative movement between the electronics canister section 104 and the spool section 106 dispenses the fiber optic line sensor 208. The launch vehicle 110 travels in a predetermined pattern laying down the fiber optic line sensor 208 in accordance with that predetermined pattern. Once the launch vehicle 110 has traveled the full length of the fiber optic line sensor 208, the free end of the fiber optic line sensor falls out of the spool section 106. This disconnects the fiber optic line sensor 208 from the launch vehicle 110. The launch vehicle 110 returns to the rendezvous point.

A loose interface is maintained between the electronics canister section 104 and the spool section 106 such that they are not rigidly connected. This allows the electronics canister section 104 and the antenna section 102 to freely separate from the spool section 106 and fall away from the launch vehicle 110 when the quick release shackles 114 are opened.

The curved shape of the protective cover 216 on the forward end of the electronics canister section 104 has another purpose. The curved shape of the protective cover 216 is used to force the electronics canister section 104 and antenna section 102 away from the spool section 106 as the protective cover falls away from the launch vehicle 110. Because the protective cover 216 is curved, the cover extends inside of the spool section 106. As such, the protective cover 216 cannot fall straight down. The protective cover 216 must push back and away as the protective cover falls away from the spool section 106. By doing so, the fiber optic line sensor 208 is prevented from being sheared off as the electronics canister section 104 slides past the spool section 106.

The fiber optic line sensor 208 is used to sense the pressure fluctuations that are created by a passing surface ship or submarine. The fiber optic line sensor 208 has a tensile strength that is strong enough to prevent the fiber optic line sensor from breaking under deployment tensile loads. The fiber optic line sensor 208 is also negatively buoyant such that the fiber optic line sensor will sink and pull out of the spool section 106 as the fiber optic line sensor falls to the seafloor.

The mechanical spring band 108 is used to connect the antenna section 102 to the electronics canister section 104. In one embodiment, the mechanical spring band 108 is secured using a safety clip and lock. The spring band 108 is locked in place when the sections are assembled. The locks remain in place while the sections are being handled and loaded underneath the launch vehicle 110. The locks are removed after the deployment system is prepared for final deployment. At that point, the safety clips prevent the spring bands 108 from releasing. The lanyard 112 removes the safety clips once the electronics canister section 104 and the antenna section 102 have fallen a predetermined distance from the launch vehicle 110. The spring band 108 is then released. The release allows the antenna section 102 to separate from the electronics canister section 104 and ascend to the surface. The spring band 108 remains attached to the electronics canister section 104 at a hinge point.

Once the lanyard 112 has reached the end of its length, the lanyard will pull a safety clip (not shown) off the mechanical spring band 108. Once the safety clip is removed, the lanyard 112 retracts back into a housing to avoid entanglement with the propulsion system of the launch vehicle 110.

The launch vehicle 110 is capable of delivering the antenna section 102 and the electronics canister section 104 to a shallow water coastal environment. In addition, the launch vehicle 110 lays down the fiber optic line sensor 208 in a prescribed pattern. In one embodiment, the launch vehicle 110 includes a linear actuator (not shown) that is connected, via a cord, to the quick release shackles 114. Once in position, the launch vehicle 110 operates the linear actuator and starts deploying the fiber optic line sensor 208.

The deployment system of the present invention minimizes the tensile load placed on the fiber optic line sensor 208 by loosely winding the sensor and by using a weak binder. Other methods, which make use of a capstan, place much greater loads on the sensor. By deploying the fiber optic line sensor 208 from a loose winding, the tensile loads are limited to the strength of the binder and the comparatively small inertial loads created by the weight of the sensor 208. The only other loads that are experienced by the sensor 208 are friction loads and water resistance loads.

Another operational advantage of the fiber optic deployment system is coastal accessibility. The fiber optic deployment system does not have to be deployed from surface ships or submarines that do not have access to shallow water coastal areas. The deployment system of the present invention can be used in areas as shallow as fifteen feet. The deployment system of the present invention can include a reflective coating on the exterior of sections to mirror the surroundings of the deployment system.

The deployment system of the present invention can be used with various launch vehicle platforms. The deployment system can be deployed from surface ships, small boats, helicopters, and planes, in addition to being deployed from a large UUV.

The ends of the electronic canister section 104 are arranged with protective covers. The protective covers act as a damage avoidance system and minimize shock loads during bottom impact. The protective covers also prevent the electronics canister section 104 from landing upright and vertical after deployment. In addition, the protective sections prevent the fiber optic line sensor 208 and the buoyant antenna cable from being pinched or damaged when the electronics canister section hits the seafloor.

When the launch vehicle is a large UUV, the quick release shackles 114 are actuated by a linear actuator and the lanyard 112 releases the spring band. A slight modification to these features may be necessary for some of the alternative deployment options. If the launch vehicle is a surface ship or craft, the quick release shackles 114 and lanyard 112 would not be necessary as the electronics canister section and buoy antenna section could be tossed over the side of the surface ship. The fishline spool section may be hung over the side. The ship would then pay out the fiber optic line sensor 208 in much the same way as the large UUV.

If the launch vehicle is an aircraft, the quick release shackles 114 and lanyard 112 would not be necessary. The electronics canister section 104 and the antenna section 102 could be thrown from the aircraft. The spool section 106 would remain with the aircraft in an analogous way as the large UUV.

The fiber optic sensor deployment system is arranged for containment inside a cylinder, which is compatible with all submarine torpedo tubes. In the submarine deployment application, no quick release shackles or lanyards would be necessary. The sections are deployed using the same weapon ejection system used for torpedoes. The spool section 106 would remain inside the torpedo tube while the antenna section 102 and electronics canister section 104 is ejected.

Referring to FIGS. 11-14, an embodiment of a deployment system in accordance with the present invention including an UUV is illustrated deploying the fiber optic line sensor 208. Initially, the quick release shackles attached to the buoyant antenna section 102 and the electronics canister section 104 are triggered and these two sections fall away from the UUV. The lanyard attached to the UUV and the spring band extends and the electronics canister section 104 begins to pull the fiber optic line sensor 208 from the spool section 106. The spool section 106 remains attached to the UUV by a fixed mount.

Figure 12:
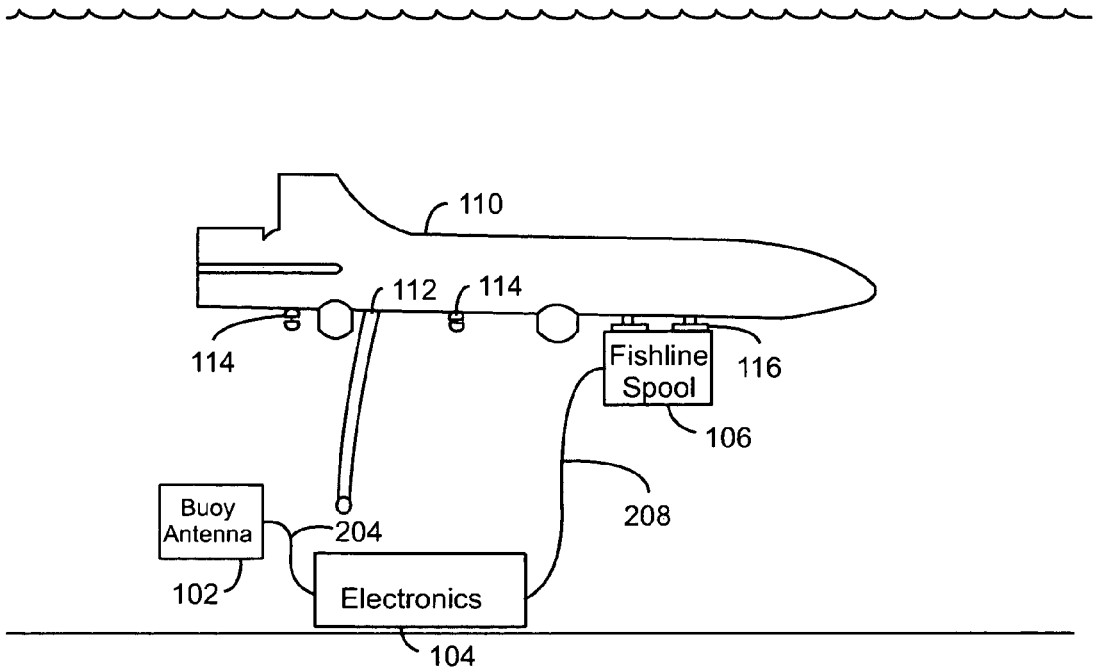
FIG. 12 is a side view illustrating the triggering of the spring band by the retractable lanyard.
Figure 13:
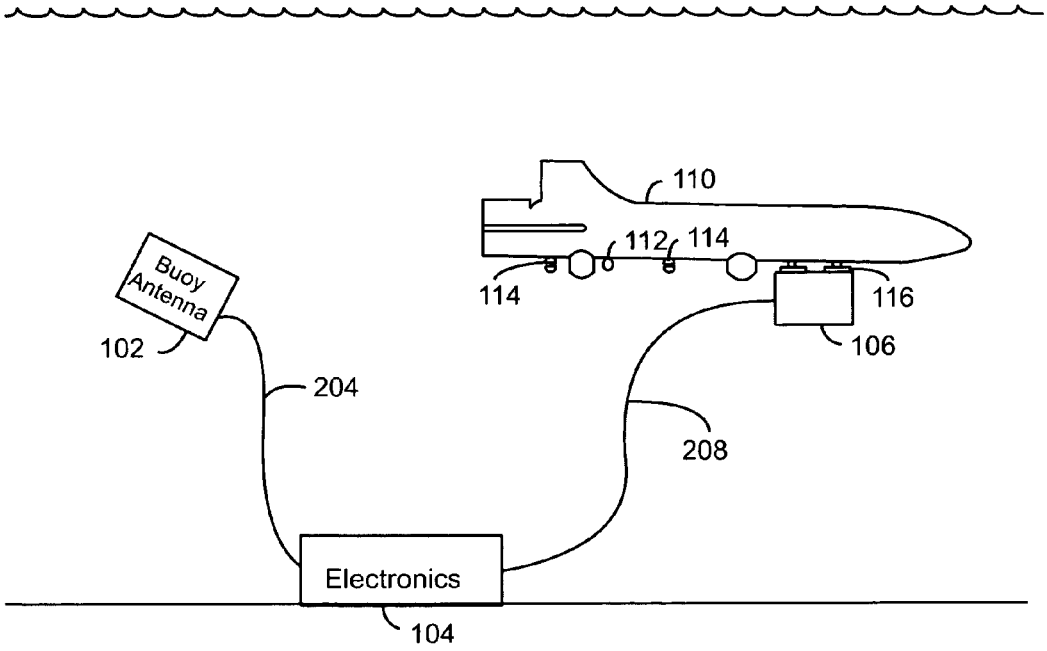
FIG. 13 is a side view illustrating the separation of the sections and deployment of the fiber optic line sensor.
Figure 14:
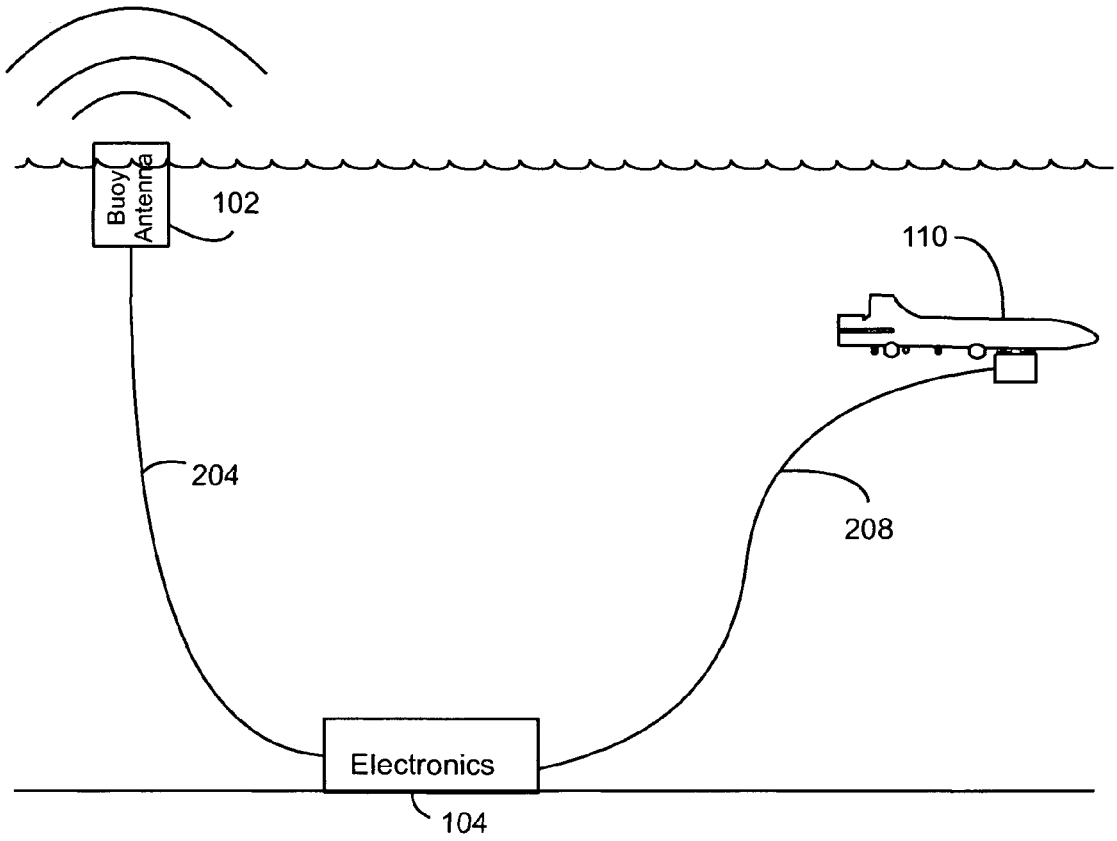
FIG. 14 is side view illustrating the continued deployment of the fiber optic line sensor.

As shown in FIG. 12, when the lanyard 112 extends to a full length, the spring band 108 is opened. This allows the positively buoyant antenna section 102 to separate from the negatively buoyant electronics canister section 104. The electronics canister section 104 falls to the ocean floor and the antenna section 102 continues to rise to the surface; thereby, extending a communication cable between the two sections (FIG. 13). The fiber optic line sensor 208 continues dispense from the spool section 106 as the UUV moves away in accordance with a predefined path. The antenna section 102 reaches the surface where the antenna section can broadcast to a receiving station and the UUV follows the prescribed path until the length of the fiber optic line sensor 208 is dispensed (FIG. 14).

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A deployment system for fiber optic line sensors, said deployment system comprising:

a cylindrical buoyant antenna section including an antenna;

a cylindrical electronics canister section including control electronics with said electronics canister section mechanically secured to said antenna section by a releasable spring band;

a communications cable attached to said antenna and said control electronics and extending between said antenna section and said electronics canister section; and a cylindrical spool section having a spool of a fiber optic line sensor, said spool section in contact with said electronics canister section with said fiber optic line sensor extending from said spool section into said electronics canister section onto said control electronics.

2. The deployment system of claim 1, wherein said antenna section, said electronics canister section and said spool section are coaxially aligned.

3. The deployment system of claim 1, wherein said antenna section is positively buoyant.

4. The deployment system of claim 1, wherein said antenna section further comprises a convex end cap attached to an end of said antenna section opposite of said electronics canister section.

5. The deployment system of claim 1, wherein said electronics canister section further comprises two convex protective covers, a first protective cover disposed between said electronics canister section and said antenna section and a second protective cover disposed between said electronics canister section and said spool section.

6. The deployment system of claim 5, wherein each protective cover is circular and comprises:

a central aperture to accommodate one of said communications cable and said fiber optic line sensor; and a well disposed around said central aperture to prevent damage to said communications cable and said fiber optic line sensor when said electronics canister section contacts a sea floor.

7. The deployment system of claim 5, wherein each protective cover further comprises a plurality of apertures to allow water to flow freely through said protective, cover.

8. The deployment system of claim 5, wherein said electronics canister section further comprises two ends plates with each of said end plates disposed between one of said protective covers and said electronics canister section thereby providing a seal.

9. The deployment system of claim 1, further comprising a triggering mechanism attached to said spring band.

10. The deployment system of claim 1, further comprising quick release shackles, a first quick release shackle attached to said antenna section and a second quick release shackle attached to said electronics canister section, both quick release shackles arranged to provide releasable attachment of their respective sections to a launch vehicle.

11. The deployment system of claim 1, further comprising a rigid mount attached to said spool section, said rigid mount arranged to provide fixed attachment of said spool section to a launch vehicle.

12. A deployment system for fiber optic line sensors, said deployment system comprising:

a launch vehicle;

a cylindrical buoy antenna section having an antenna and releasably attached to said launch vehicle by a first quick release shackle;

a cylindrical electronics canister section having control electronics and releasably attached to said launch vehicle by a second quick release shackle, said electronics canister section in contact with said antenna section and secured to said antenna section by a spring band;

a communications cable attached to said antenna and said control electronics and extending between said antenna section and said electronics canister section; and a cylindrical spool section comprising a spool of a fiber optic line sensor and attached to said launch vehicle by a rigid mount, said spool section in contact with said electronics canister section and said fiber optic line sensor extending from said spool section into said electronics canister section onto said control electronics.

13. The deployment system of claim 12, wherein said launch vehicle is an unmanned undersea vehicle.

14. The deployment system of claim 12, further comprising a triggering mechanism attached to said spring band and said launch vehicle to trigger said spring band and separate said antenna section from said electronics canister section as said antenna section and said electronics canister section separate from said launch vehicle.

15. The deployment system of claim 14, wherein said triggering mechanism includes a retractable lanyard.

16. The deployment system of claim 15, wherein said electronics canister section further comprises two convex protective covers, a first protective cover disposed between said electronics canister section and said buoy antenna section and a second protective cover disposed between said electronics canister section and said spool section.

17. The deployment system of claim 16, wherein each protective cover is circular and comprises:

a central aperture to accommodate one of said communications cable and said fiber optic line sensor; and a well disposed around said central aperture.

* * * * *